United States Patent [19]

Thigpen

[11] Patent Number: 4,656,768

[45] Date of Patent: Apr. 14, 1987

[54] WIND DRIVEN SIGN

[76] Inventor: James C. Thigpen, P.O. Box 994, Shallotte, N.C. 28459

[21] Appl. No.: 347,020

[22] Filed: Feb. 8, 1982

[51] Int. Cl.[4] ..... G09F 19/08

[52] U.S. Cl. ..... 40/412; 40/422; 40/477

[58] Field of Search ..... 46/131, 173, 53, 54, 46/55, 56, 57; 40/424, 613, 412

[56] References Cited

U.S. PATENT DOCUMENTS

| | | | |
|---|---|---|---|
| 624,639 | 5/1899 | Frazee et al. | 46/131 |
| 1,930,164 | 10/1933 | Fletcher | 40/424 |
| 2,002,675 | 5/1935 | Outcault | 40/424 |
| 2,728,154 | 12/1955 | Ross et al. | 40/440 |
| 3,273,283 | 9/1966 | Wolf | 46/173 |
| 3,818,630 | 6/1974 | May | 46/131 |
| 4,089,130 | 5/1978 | Byrnes | 40/613 |

FOREIGN PATENT DOCUMENTS

| | | | |
|---|---|---|---|
| 492221 | 2/1930 | Fed. Rep. of Germany | 46/173 |
| 503564 | 7/1930 | Fed. Rep. of Germany | 46/173 |
| 989681 | 5/1951 | France | 40/440 |

*Primary Examiner*—Gene Mancene
*Assistant Examiner*—Wenceslao J. Contreras
*Attorney, Agent, or Firm*—Mills & Coats

[57] ABSTRACT

This invention is a wind driven sign preferably in the form of a human character wherein the arms of the sign will move when the wind is blowing to attract attention to the business establishment or other location adjacent said sign. This is accomplished through a single blade thus the movement of the appendages of the sign are not propeller movement but an arm-like movement thereby adding even more to the fascination and effect of the same.

6 Claims, 2 Drawing Figures

WIND DRIVEN SIGN

FIELD OF INVENTION

This invention relates to visual displays and more particularly to wind driven animated sign means.

BACKGROUND OF INVENTION

In the past various means have been developed to attract attention to places of business, particularly in more open areas such as on the highways and by-ways of the country where a person's attention might not immediately be attracted to the establishment but for some eye-catching attraction.

Such things as flashing lights, rotating signs, and the like as well as wind driven devices that change exhibits or have other features have been developed. Even bird-like shapes with propellers for wings have been used.

All of these systems, although somewhat effective, have their drawbacks. The electrically lit and electrically driven signs, of course, require energy sources which are escalating in price while the prior known wind-driven systems, although not costing anything to operate, do not have the attracting ability of the power driven signs. Many of these wind-driven devices also have the problem that it takes a relatively strong wind to drive the same and when the wind blows above a certain point they either move so fast that they are not recognizable or they will actually tear themselves apart due to overspeed.

BACKGROUND OF INVENTION

After much research and study into the above-mentioned problems, the present invention has been developed to provide a sign means which is attractive and eye-catching even in a static, nonoperative condition and yet with the slightest movement of air, will give gestures which attract attention to the sign and thus the business or other establishment in conjunction with which it is used.

Although the sign of the present invention is designed to operate under minimum air movement conditions, it will not loose its effectiveness due to high wind conditions and it is so structured as to not have the tendency to separate and disintegrate due to overspeed.

The above is accomplished through unique, extremely sensitive wind drive appendage arms which are counterbalanced for proper operative effect. The basic structure of the present invention is preferably in the shape of a human character which gives the same a unique attractiveness of its own.

In view of the above, it is an object of the present invention to provide a wind-driven sign which is an effective attention getter in both static and operative conditions.

Another object of the present invention is to provide a wind-driven attractor which will be activated by only soft wisps of air and yet will continue to operate properly under high wind conditions without structural damage or deminishment of eye appealing effect.

Another object of the present invention is to provide a character with appendages which in static condition will be disposed horizontally and yet will begin to move in light airs to attract attention to the same.

Another object of the present invention is to provide a counterbalance appendage on a character type attracting sign whereby an improved display system is provided.

Other objects and advantages of the present invention will become apparent and obvious from a study of the following description and the accompanying drawings which are merely illustrative of such invention.

DETAILED DESCRIPTION OF INVENTION

Figure 1:
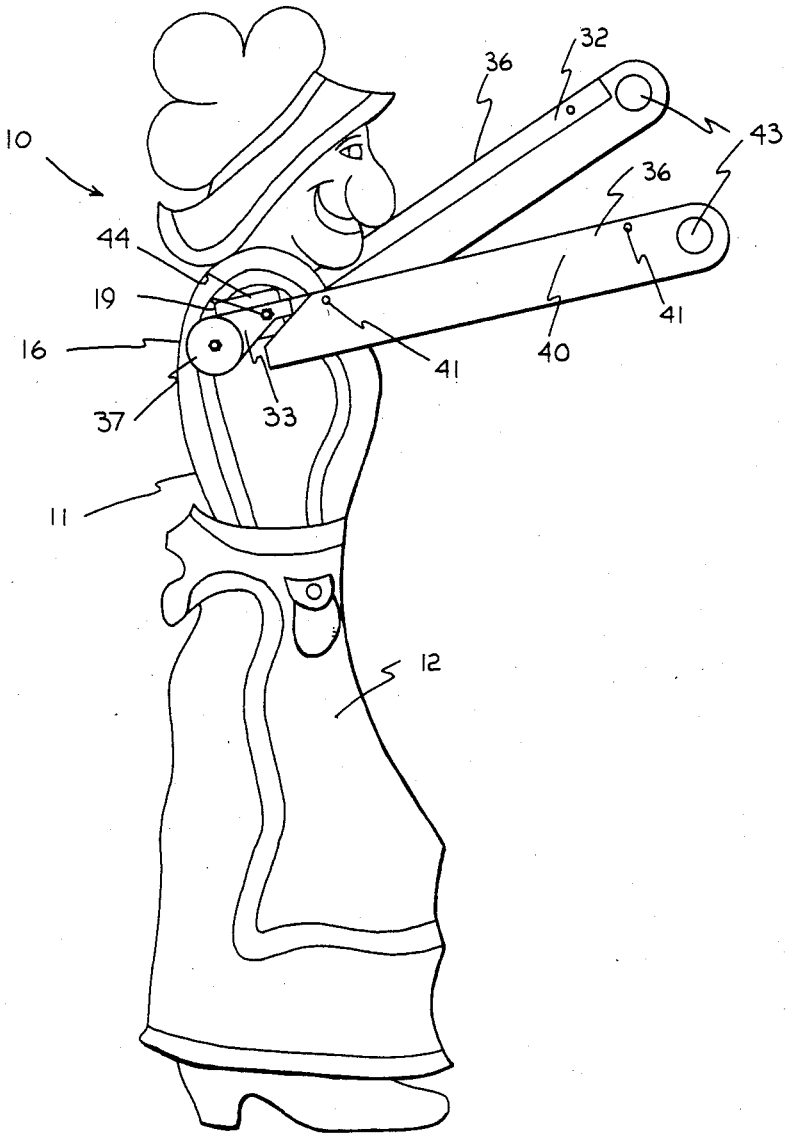
FIG. 1 is a side elevational view of the wind driven sign of the present invention.

With further reference to the drawings, the wind driven sign of the present invention indicated, generally at 10, includes a body portion 11 formed preferably from two pieces of sheet material such as plywood as indicated at 12. These two side members 12 are spaced at 12' and can be shaped to look like a woman, a man, or other character.

Reinforcing plates 14 formed from plywood or other suitable material are fixedly secured by gluing, tacking or other suitable means to the exterior of side members 12. These reinforcing plates are preferably disposed in the shoulder area 16 of the body 11.

Figure 2:
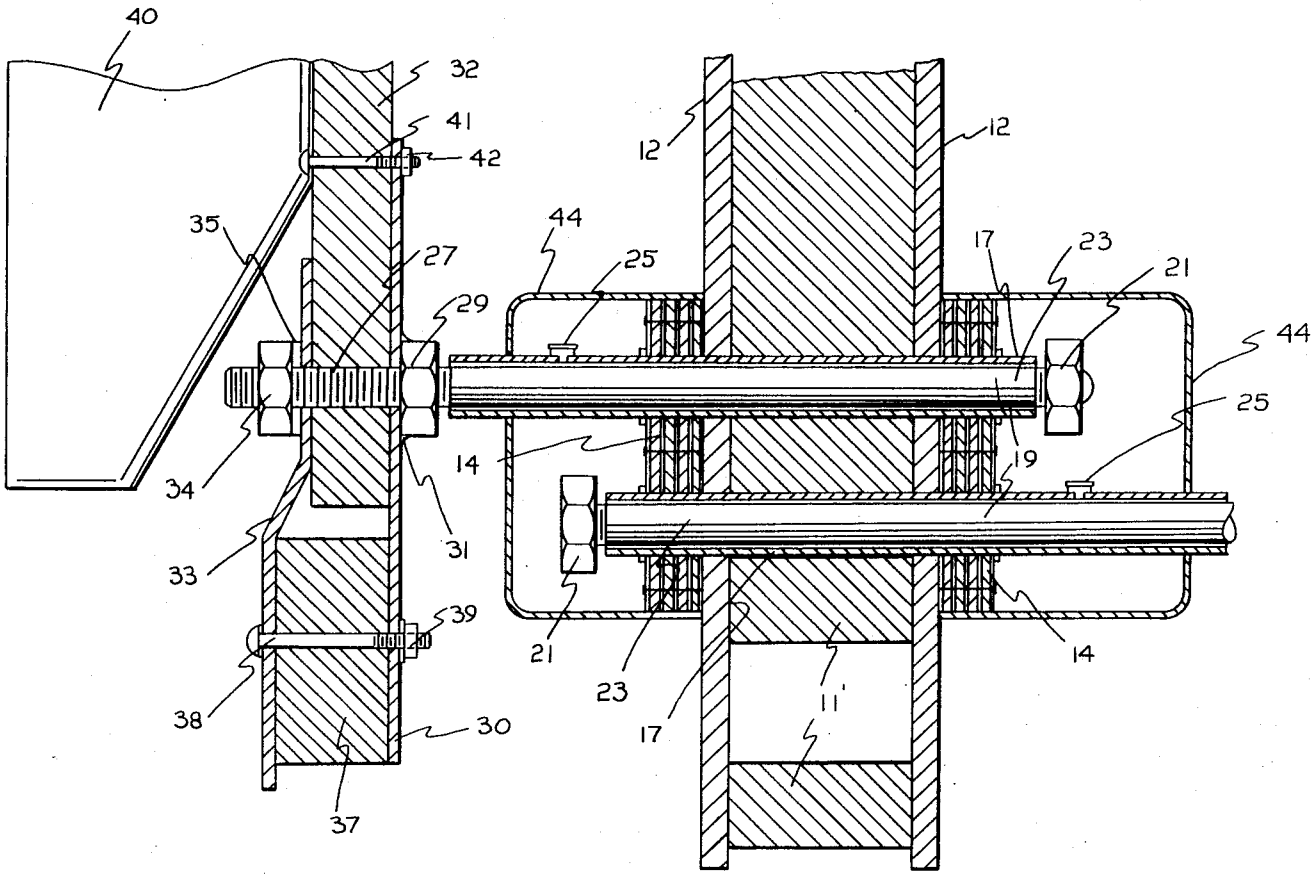
FIG. 2 is an enlarged cutaway view of the counterbalanced appendage mcunting means.

Bearing tubes 17 pass through the side members 12 and their respective reinforcing plates or blocks 14 and extend outwardly some distance on opposite side thereof as can clearly be seen in FIG. 2.

Appendage supporting shafts 19 are rotatively mounted within bearing tubes 17. These support shafts are threaded on both ends with nuts 21 threaded onto the short ends 23. These nuts 21 are preferably locked in place on their respective shafts 19 by means such as weldment, set screws, or the like.

Lubricant fittings 25 are provided in bearing tubes 17. Since the purpose of fittings of this type are well known to those skilled in the art, further detailed description of the same is not deemed necessary.

The extension ends 27 of shafts 19 each includes a nut-like member 29 threaded onto such end with a backing plate 38 fixed thereto by weldment as indicated at 31 or by other suitable means.

A reinforcing rod 32 is passed over each of the extension ends 27 of shafts 19 to a point juxtaposed to backing plate 30. End plate 33 is placed on each of the extension ends juxtaposed to each of the reinforcing rods 32. A nut means 34 is tightened down against lock washer 35 to complete the mounting of the appendage 36.

A counterbalance weight 37 is mounted between backing plate 30 and end plate 33 and is held in place by bolt 38 and its related nut 39.

Each of the reinforcing rods 32 of the appendages 36 includes a blade portion 40 disposed at an angle therefrom and held in place relative thereto by bolts 41 and their related nuts 42.

The hand ends of each of the appendages 36 preferably includes a reflector type device 43 for attracting attention to the sign.

A shaft housing 45 is provided for each of the appendage support shafts and preferably fits over reinforcing plate 14 as can clearly be seen in FIG. 2.

Considering the appendage supporting shafts 19 as a fulcrum point, the counterbalance weight end and the appendage end of the arm-like blade are substantially equal with possibly a slight bit more weight being on the counterbalance end so that in rest, no wind conditions, the arms will be basically in the position shown in FIG. 1.

From extensive experimentation it has been determined that a good weight for the appendage arms is eight pounds on the counterbalance end of the fulcrum point and approximately eight pounds on the other or blade end.

Thus it can be seen that because of the ease of rotation of the appendages 36 through bearing tubes 17, even the slightest breath of air against appendage blades 40 will cause the respective appendage 36 to rotate. The more air impinging against the appendages the faster the arms will rotate thus creating a very eye-catching motion. If the sign 10 is placed in front of a business establishement, perspective customers will be attracted thereto by the movement of the sign at no operating cost to the proprietor thereof.

Although an old country woman is shown in FIG. 1, an old man, or any other desirable character can be incorporated into body 11.

From the above it can be seen that a relatively inexpensive and yet highly efficient wind driven sign is provided which is attractive in static position and very eye catching when in wind driven rotation. Further any number of interesting characters can form body 11 thus adding even greater utility to the wind driven sign of the present invention.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A wind driven means comprising: a support means; at least one elongated appendage means having a blade end which is set at an angle to the wind and a counterbalance end; means adjacent said counterbalance end for rotatively mounting said appendage means on said support means; and a counterbalance weight means mounted on said counterbalance end to approximately equalize the weight of each end of said appendage on either side of said rotative mounting thereof on said support means whereby an appendage is provided which can be easily rotatively driven by ambient air currents in a whirling motion but which includes only a single outwardly extending blade-like means.

2. The wind driven means of claim 1 wherein said support means is in the form of a human character.

3. The wind driven means of claim 2 wherein said blade end of said appendage is arm shaped in configuration.

4. The wind driven means of claim 3 wherein said arm-shaped appendage includes a reflector means adjacent its outermost end.

5. The wind driven means of claim 1 wherein the means for rotatively mounting said appendage to said support means is a shaft-like means rotatively mounted within a bearing tube means.

6. The wind driven means of claim 5 wherein said bearing tube means includes the lubricating fitting.

* * * * *